US005345640A

United States Patent [19]

Goss

[11] Patent Number: 5,345,640

[45] Date of Patent: Sep. 13, 1994

[54] MOTORIZED BACK SCRUBBER

[76] Inventor: Mary A. Goss, 2756 Westberry Dr., Santa Rosa, Calif. 95403

[21] Appl. No.: 98,041

[22] Filed: Jul. 28, 1993

[51] Int. Cl.[5] ..... A46B 13/04; A47K 7/04

[52] U.S. Cl. ..... 15/88.2; 15/21.1; 4/606

[58] Field of Search ..... 15/21.1, 88.2, 88.3, 15/97.1; 4/606

[56] References Cited

U.S. PATENT DOCUMENTS

| | | | |
|---|---|---|---|
| 1,609,796 | 12/1926 | Cheney | 15/21.1 |
| 2,730,737 | 1/1956 | Herman | 15/88.2 |
| 3,196,867 | 7/1965 | Perry | 15/88.3 |
| 4,008,503 | 2/1977 | Tharp | 15/88.3 |
| 4,432,113 | 2/1984 | Gouge | 15/88.2 |
| 5,239,712 | 8/1993 | Kinder | 15/21.1 |

FOREIGN PATENT DOCUMENTS

| | | | |
|---|---|---|---|
| 2347001 | 11/1977 | France | 4/606 |

*Primary Examiner*—Edward L. Roberts
*Attorney, Agent, or Firm*—Gary Alan Culliss

[57] ABSTRACT

A motorized scrubber for effectively cleaning a dorsal portion of an individual. The scrubber includes a plurality of rotating brushes powered by an electric motor. The device may be conveniently secured to a shower wall or the like by suction cups provided thereon. A soap dispenser provides soap to a center area of each of the plurality of brushes and an alternate embodiment of the present invention includes a water supply assembly for rinsing a user's back.

6 Claims, 4 Drawing Sheets

MOTORIZED BACK SCRUBBER

BACKGROUND OF THE INVENTION

1. Field of the Invention

The present invention relates to brushes and more particularly pertains to a motorized back scrubber which may be utilized for cleaning a dorsal portion of an individual.

2. Description of the Prior Art

The use of brushes is known in the prior art. More specifically, brushes heretofore devised and utilized for the purpose of cleaning a user's back are known to consist basically of familiar, expected and obvious structural configurations, notwithstanding the myriad of designs encompassed by the crowded prior art which have been developed for the fulfillment of countless objectives and requirements.

For example, a back scrubber is illustrated in U.S. Pat. No. 5,044,806 which contains a bar of soap for application by bathers and others who need a convenient way to clean hard to reach areas along their backs. The back scrubber will securely engage a conventional soap bar and when the bar has been substantially consumed, a releasable Jaw allows for easy substitution of a fresh bar of soap.

A water powered back scrubber is disclosed in U.S. Pat. No. 4,704,756 which incorporates a reciprocating brush operated by a water pump that utilizes water diverted from a shower head supply line. The device includes a supporting member securely mounted to a wall of the shower which supports the reciprocating brush so as to allow the same to move up and down as directed by the water pump.

Another patent of interest is U.S. Pat. No. 3,612,044 which describes a back massage and scrub fixture which includes a shallow free with a concave back that supports a friction pad having a multiplicity of friction fingers of equal length thereon. Suction cups on the frame backs secure the frame and pad to a support surface such as a wall of a shower or the like. The friction fingers define a horizontally concave area adapted to fit and scrub the human back.

While these devices fulfill their respective, particular objectives and requirements, the aforementioned patents do not describe a motorized scrubber for effectively cleaning a dorsal portion of an individual that includes a plurality of rotating brushes powered by an electric motor. In this respect, the motorized back scrubber according to the present invention substantially departs from the conventional concepts and designs of the prior art, and in so doing provides an apparatus primarily developed for the purpose of cleaning a dorsal portion of an individual.

SUMMARY OF THE INVENTION

In view of the foregoing disadvantages inherent in the known types of brushes now present in the prior art, the present invention provides a new motorized back scrubber construction wherein the same can be utilized for effectively cleaning a dorsal portion of an individual. As such, the general purpose of the present invention, which will be described subsequently in greater detail, is to provide a new motorized back scrubber apparatus which has many of the advantages of the brushes mentioned heretofore and many novel features that result in a motorized back scrubber which is not anticipated, rendered obvious, suggested, or even implied by any of the prior art brushes, either alone or in any combination thereof.

To attain this, the present invention essentially comprises a motorized scrubber for effectively cleaning a dorsal portion of an individual. The scrubber includes a plurality of rotating brushes powered by an electric motor. The device may be conveniently secured to a shower wall or the like by suction cups provided thereon. A soap dispenser provides soap to a center area of each of the plurality of brushes and an alternate embodiment of the present invention includes a water supply assembly for rinsing a user's back.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new motorized back scrubber apparatus which has many of the advantages of the brushes mentioned heretofore and many novel features that result in a motorized back scrubber which is not anticipated, rendered obvious, suggested, or even implied by any of the prior art brushes, either alone or in any combination thereof.

It is another object of the present invention to provide a new motorized back scrubber which may be easily and efficiently manufactured and marketed.

It is a further object of the present invention to provide a new motorized back scrubber which is of a durable and reliable construction.

An even further object of the present invention is to provide a new motorized back scrubber which is susceptible of a low cost of manufacture with regard to both materials and labor, and which accordingly is then susceptible of low prices of sale to the consulting public, thereby making such motorized back scrubbers economically available to the buying public.

Still yet another object of the present invention is to provide a new motorized back scrubber which provides in the apparatuses and methods of the prior art some of the advantages thereof, while simultaneously overcoming some of the disadvantages normally associated therewith.

Still another object of the present invention is to provide a new motorized back scrubber for effectively cleaning a dorsal portion of an individual.

Yet another object of the present invention is to provide a new motorized back scrubber which includes a plurality of rotating brushes powered by electric motor.

Even still another object of the present invention is to provide a new motorized back scrubber which may be conveniently secured to a shower wall or the like by suction cups provided thereon.

Even still yet another object of the present invention is to provide a new motorized back scrubber which includes a soap dispenser that provides soap to a center area of each of a plurality of brushes.

Even still another further object of the present invention is to provide a new motorized back scrubber which includes a water supply assembly for rinsing a user's back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
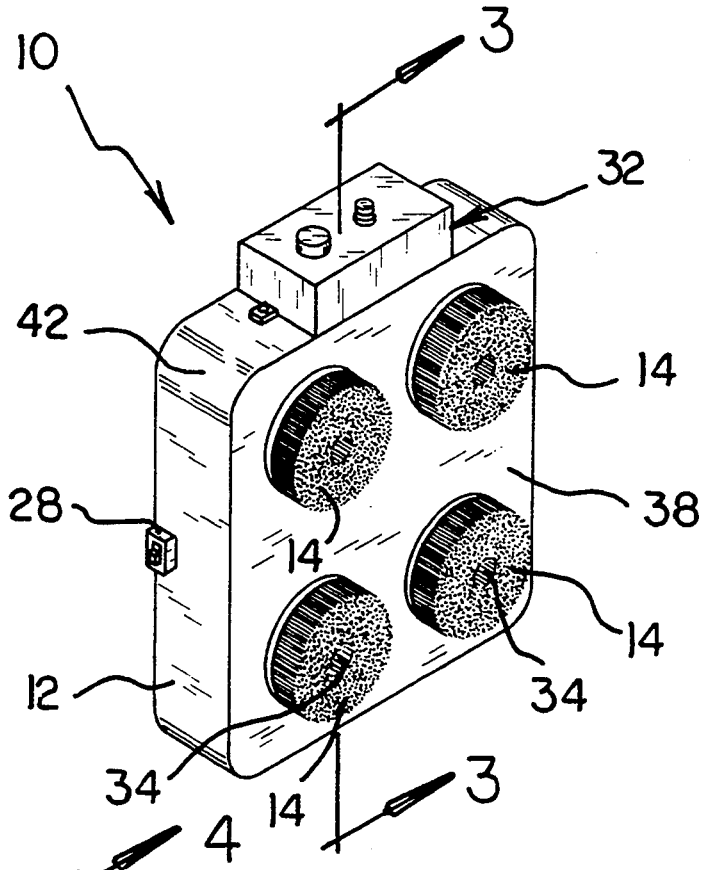
FIG. 1 is a perspective view of a first embodiment of a motorized back scrubber comprising the present invention.

With reference now to the drawings, and in particular to FIGS. 1–5 thereof, a new motorized back scrubber embodying the principles and concepts of the present invention and generally designated by the reference numeral 10 will be described.

The motorized back scrubber 10 comprises a substantially rectangular case 12 which has a plurality of substantially circular brushes 14 rotatably supported thereby, as best illustrated in FIG. 1. The case includes a plurality of suction cups 16 which allow the motorized back scrubber 10 to be removably secured to a wall of a shower or bathtub. Each of the plurality of brushes 14 is mechanically coupled to a brush gear 18 which meshes with a motor gear 20 powered by an electric motor 22. The motor 22 is in electrical communication with a plurality of batteries 24 contained within a battery compartment 26 of the case 12. The batteries 24 are electrically connected to a switch 28 through a plurality of wires 30, whereby a user may selectively operate the scrubber 10 in a well understood manner.

Figure 3:
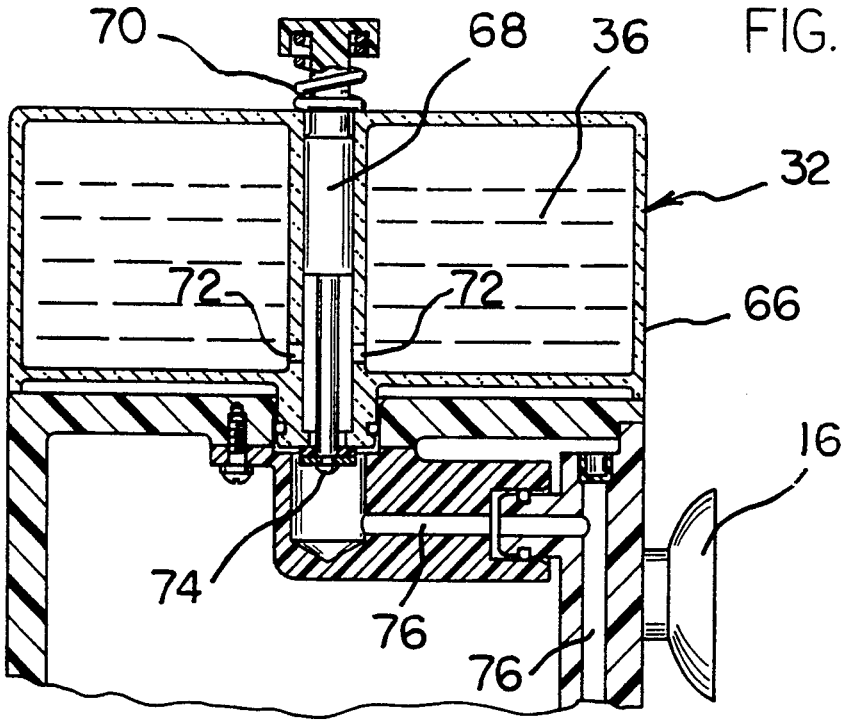
FIG. 3 is a cross sectional view of a portion of the invention taken along line 3—3 of FIG. 1.
Figure 4:
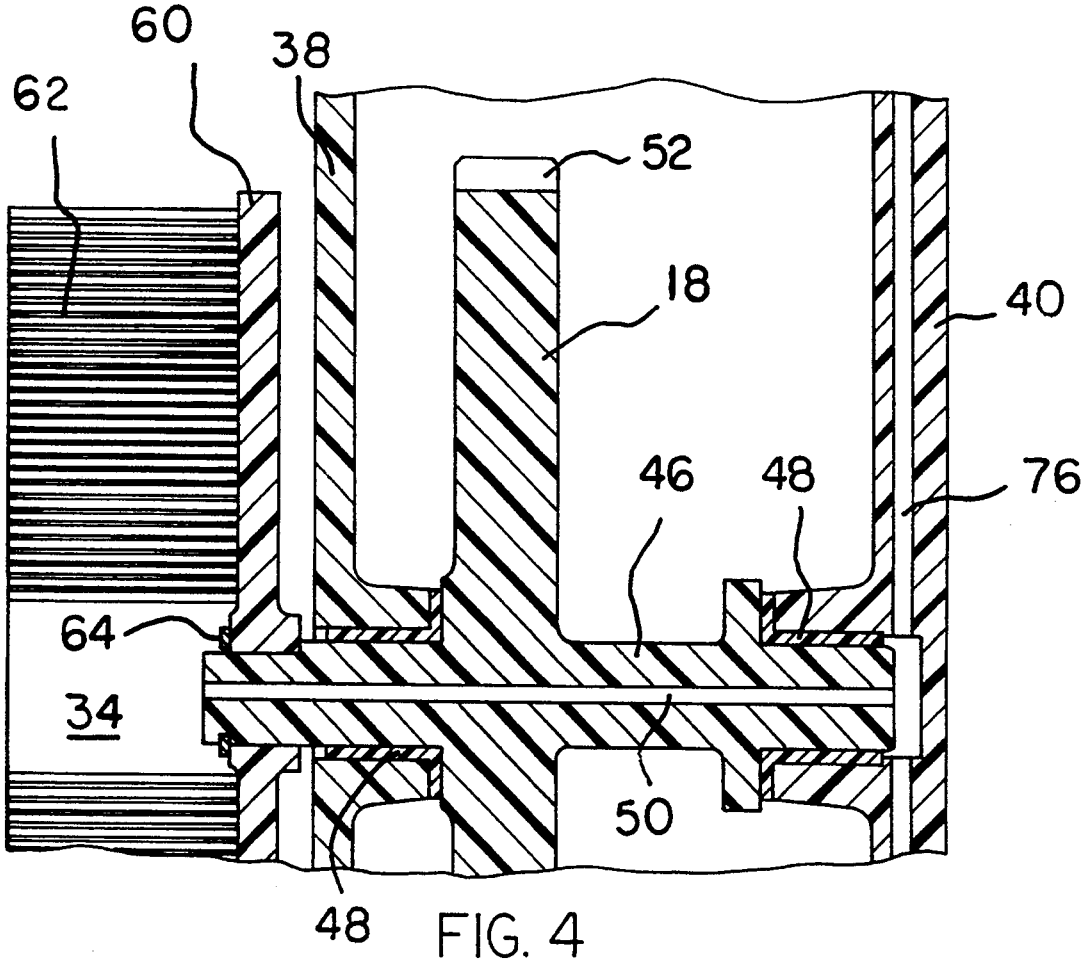
FIG. 4 is an enlarged cross sectional view of a portion of the invention taken along line 4—4 of FIG. 2.

A soap dispenser 32 is secured to a top area of the case 12 and is in fluid communication with a center area 34 of each of the plurality of brushes 14, as illustrated for one of such brushes in FIG. 3–4. The soap dispenser 32 is operable to retain a quantity of liquid soap 36 which may be selectively dispensed through the center area 34 of each of the brushes to the dorsal portion of the user.

In use, the motorized back scrubber 10 may be secured to the wall of a shower by the suction cups 16 in a well understood manner and operated by an actuation of the switch 28. Upon an energization of the motor 22, the plurality of brushes 14 will rotate. A user may clean the dorsal portion or other areas of the user's body by engaging the same against the brushes. The soap dispenser 32 may be selectively operated to allow the liquid soap 36 to flow to each of the brushes 14, thereby enhancing the cleaning ability of the device 10.

Figure 2:
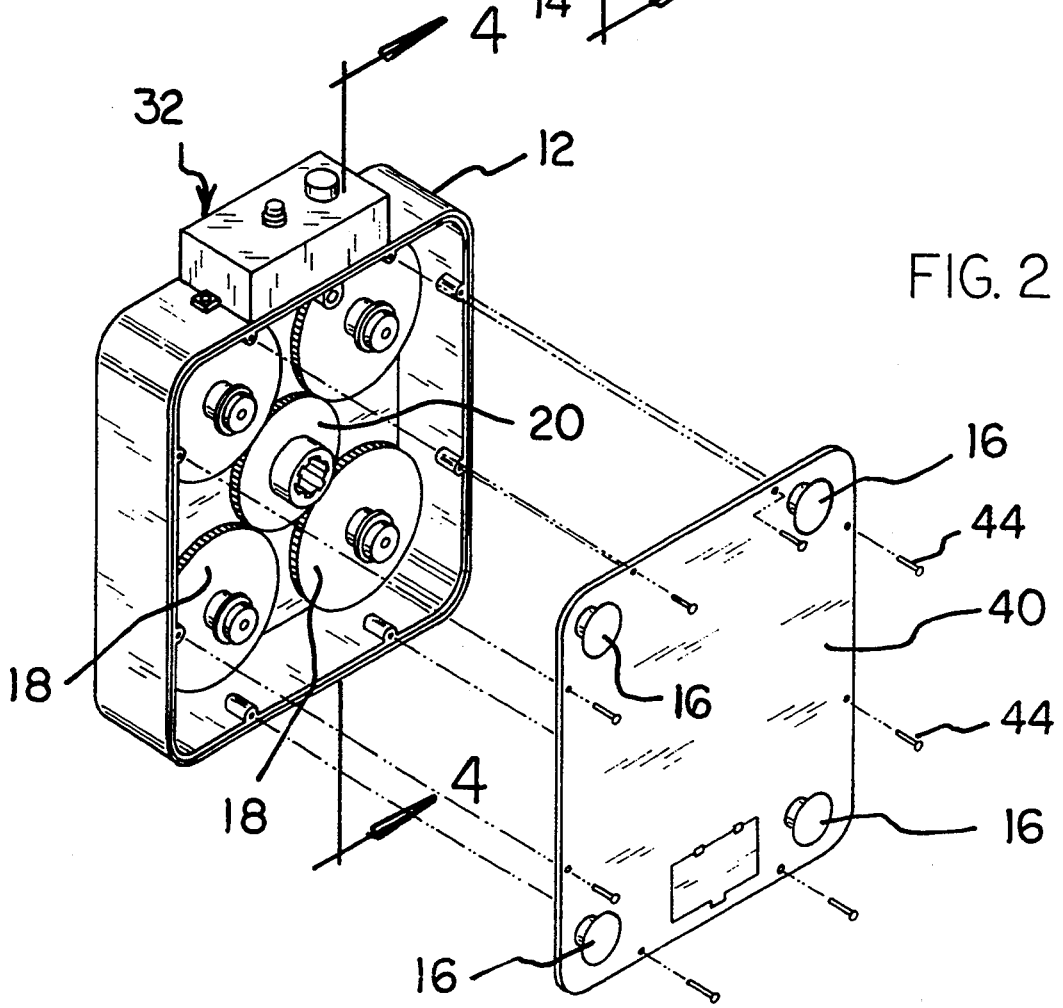
FIG. 2 is a further perspective view, partially exploded, of the present invention.

More specifically, it will be noted that the motorized back scrubber 10 comprises a case 12 having a front plate 38 of substantially rectangular shape positioned in a spaced relationship to a rear plate 40 having a substantially similar shape and connected thereto by a sidewall 42 which circumscribes and is integrally connected to the front plate along a perimeter thereof. The rear plate 40 is removably secured to the sidewall 42 by a plurality of fasteners 44. A plurality of unlabeled apertures extend through the front plate which facilitate a projection of a plurality of brush axles 46 therethrough. As best illustrated in FIG. 4, the brush axles 46 are each supported upon bearings 48 by both the front plate 38 and the rear plate 40. Each of the brush axles 46 supports a brush gear 18 and has a center pathway 50 comprising a center bore along a longitudinal length therethrough. Each of the brush gears 18 is provided with gear teeth 52 which are operable to engage a motor gear 20 supported in a center area of the case 12, as best illustrated in FIG. 2.

Figure 5:
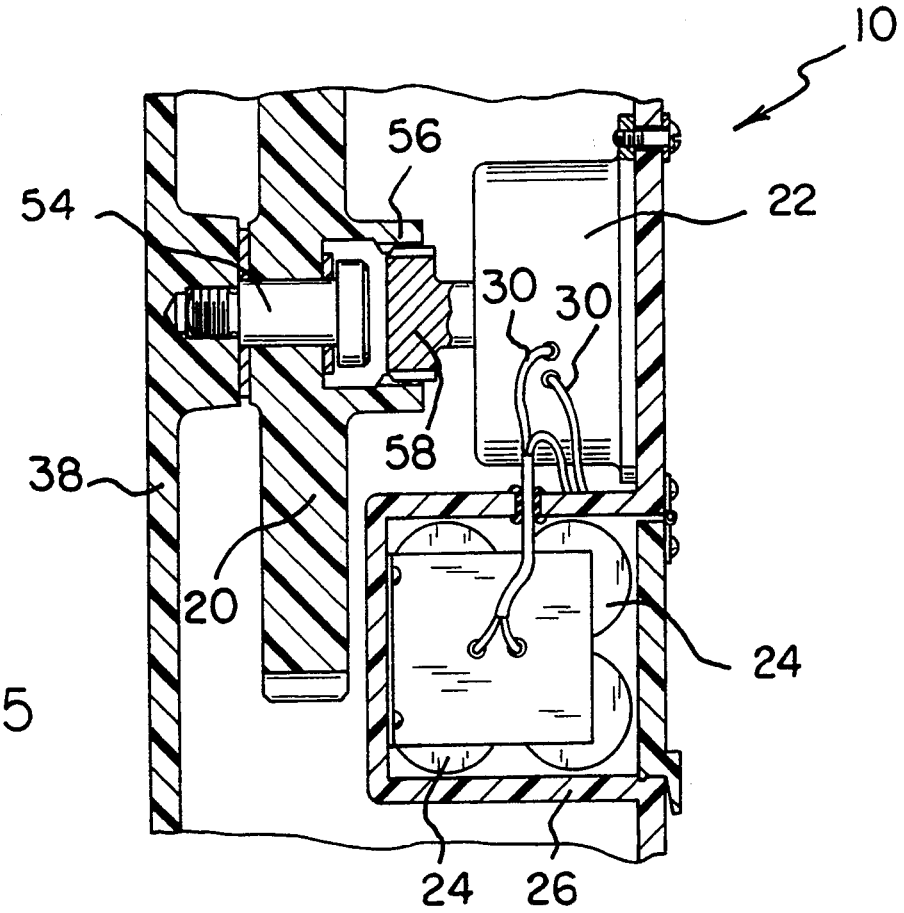
FIG. 5 is a cross sectional view of the first embodiment detailing a portion of an interior thereof.

The motor gear 20 is rotatably supported upon a motor gear axle 54 which is threadably secured to the front plate 38, as best illustrated in FIG. 5. The motor gear 20 includes a socket 56 integrally formed therein which is operable to mate with a shaft 58 of the motor 22. The motor 22 may then rotate the motor gear 20 through the socket 56, thereby rotating each of the plurality of brush gears 18 and their associated brush axles 46 and brushes 14.

Each of the plurality of brushes 14 is comprised of a brush plate 60 having a substantially circular shape and supporting a number of brush fibers 62 on an outward surface thereof. The brush fibers 62 are each comprised of a substantially flexible material which is operable to comfortably and advantageously clean the dorsal portion or other areas of user's body. The brush plate 60 is secured to the brush axle by an unillustrated keyway and an e-clip 64, as best illustrated in FIG. 4.

The soap dispenser 32 is secured to a top area of the case 12 and is comprised of a substantially rectangularly shaped container 66 in which a quantity of liquid soap 36 may be contained. The soap dispenser 32 further includes a plunger 68 passing through a center of the container 66 and supported upon a spring 70, as best illustrated in FIG. 3. The plunger 68 is operable to be depressed by a user, thereby allowing the liquid soap 36 within the container 66 to flow through a plurality of holes 72 and past a valve seal 74 into pathways 76 within the case 12. The pathways 76 are in fluid communication with the center pathway 50 of each of the brush axles 46. In this manner, the liquid soap 36 may be selectively dispensed from the container 66 to the center area 34 of each of the plurality of brushes 14.

Figure 6:
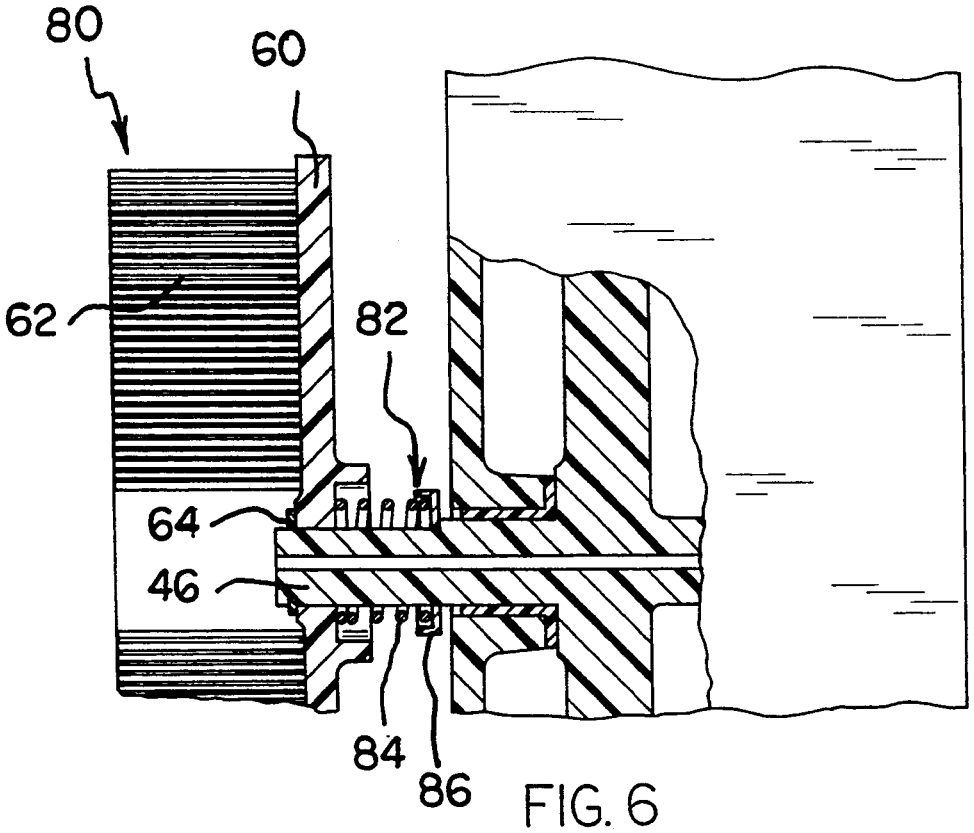
FIG. 6 is an enlarged side elevation view, partially in cross section, of a second embodiment of a motorized back scrubber comprising the present invention.

A second embodiment of the present invention of the present invention as generally designated by the reference numeral 80, which comprises substantially all of the features of the foregoing embodiment 10 and which further comprises a brush support assembly 82 will now be described. As best shown in FIG. 6, it can be shown that the brush support assembly 82 is positioned upon each of the brush axles 46 between the case 12 and the brush plate 60 and is operable to allow each of the brushes 14 to slide with respect to the brush axle 46, thereby allowing the brushes to conform to the contours of the dorsal portion and the like of user. The brush support assembly 82 comprises of a coil spring 84 positioned upon the brush axle 46 which engages both the brush plate 60 and a retainer 86.

Figure 7:
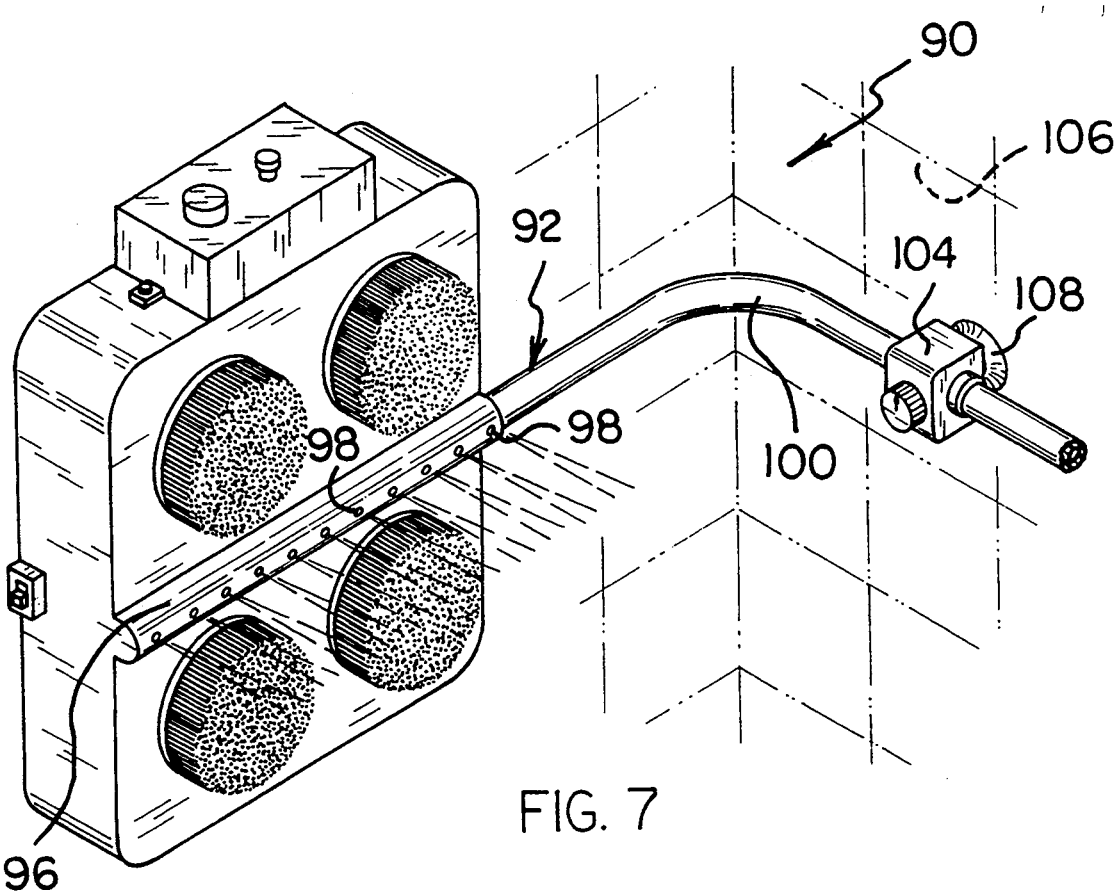
FIG. 7 is a perspective view of a third embodiment of a motorized back scrubber comprising the present invention.
Figure 8:
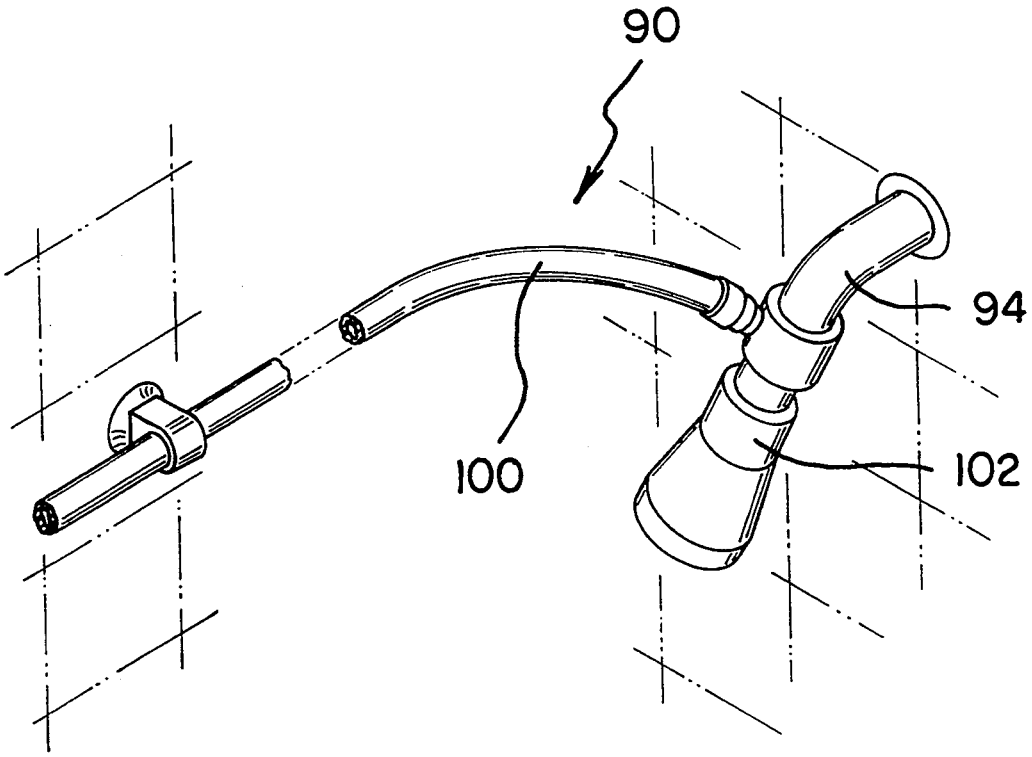
FIG. 8 is a further perspective view of a portion of the third embodiment.

Comprising all of the features and structure of the previous embodiments 10, 80 is a third embodiment which is generally designated by the reference numeral 90 and may be viewed in FIGS. 7–8. It can be shown that the third embodiment 90 further comprises a water supply assembly 92 for supplying a quantity of water from the shower water line 94 to the dorsal portion of a user. The water supply assembly 92 comprises a substantially hollow manifold 96 which is integrally or otherwise present upon the front plate 38 of the case 12 and includes a plurality of jets 98, each of which is in fluid communication with an interior of the manifold 96.

A length of flexible tubing 100 is connected to the manifold 96 and to a line tap 102 in the shower water line 94 to allow water present therein to flow through the tubing and out of the jets 98. A control valve 104 is in fluid communication with the flexible tubing 100 and is operable to selectively interrupt and throttle a flow of water from the shower water line 94 to the jets 98 in a well understood manner. The control valve 104 may be secured to a wall 106 of the shower by a suction cup 108. The water supply assembly 92 provides, in addition to the cleaning ability of the brushes 14, a user with the ability to rinse the dorsal portion of the user in a well understood manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motorized back scrubber comprising:

a case having a front plate spaced from a rear plate and a sidewall connected to a perimeter of both the front plate and the rear plate;

a mounting means for securing said case to a vertical surface;

a motor contained within said case, said motor being mechanically coupled to a motor gear;

at least one brush axle rotatably supported by said case and extending through at least one aperture in said front plate, said at least one bush axle being mechanically coupled to a brush gear in mesh with said motor gear;

a brush coupled to an end of said at least one brush axle and rotatable threrewith;

a soap dispenser means for selectively dispensing soap through said brush;

and, a brush support assembly means for movably supporting said brush on said end of said at least one brush axle.

2. The motorized back scrubber of claim 1, and further comprising a water supply assembly means for dispensing water from a shower water lie through a plurality of jets secured to said case.

3. A motorized back scrubber comprising:

a case having a front plate spaced from a rear plate and a sidewall connected to a perimeter of both the front plate and the rear plate;

a mounting means for securing said case to a vertical surface;

a motor contained within said case, said motor being mechanically coupled to a motor gear;

a plurality of brush axles each rotatably supported by said case and extending through at least one aperture in said front plate, said plurality of brush axles each being mechanically coupled to a brush gear in mesh with said motor gear;

a plurality of brushes, with each of said brushes being coupled to an end of an individual one of said plurality of brush axles and rotatable therewith;

a soap dispenser means for selectively dispensing soap through each of said brushes;

and, a brush support assembly means for movably supporting each of said brushes on said end of each of said plurality of brush axles.

4. The motorized back scrubber of claim 3, and further comprising a water supply assembly means for dispensing water from a shower water line through a plurality of jets secured to said case.

5. The new motorized back scrubber of claim 4, wherein said soap dispenser means comprises a container mounted to said case, said container being in fluid communication with a plurality of pathways in said case and a center pathway in each of said plurality of brush axles to dispense a liquid soap through a center area of each of said brushes.

6. The new motorized back scrubber of claim 5, wherein said water supply assembly means comprises a substantially hollow manifold secured to said front plate, a length of flexible tubing coupled to said manifold and releasably coupled to said shower water line, and a plurality of holes in said manifold.

* * * * *